US006053117A

United States Patent [19]

Daoud

[11] Patent Number: 6,053,117

[45] Date of Patent: Apr. 25, 2000

[54] RETRACTABLE WORK TABLE ASSEMBLY

[75] Inventor: Bassel H. Daoud, Parsippany, N.J.

[73] Assignee: Lucent Technologies, Inc., Murray Hill, N.J.

[21] Appl. No.: 09/065,122

[22] Filed: Apr. 23, 1998

[51] Int. Cl.[7] ..... A47B 11/00

[52] U.S. Cl. ..... 108/143; 108/33; 108/37

[58] Field of Search ..... 108/33, 37, 40, 108/34, 38, 42, 47, 48, 50.01, 143

[56] References Cited

U.S. PATENT DOCUMENTS

| | | | |
|---|---|---|---|
| 1,553,821 | 9/1925 | Johnson | 108/38 |
| 1,688,834 | 10/1928 | Sharp | 108/33 X |
| 1,753,423 | 4/1930 | Kroschel | 108/38 X |
| 1,768,413 | 6/1930 | Lyth | 108/33 X |
| 2,586,543 | 2/1952 | Kennedy | 108/33 X |

*Primary Examiner*—Jose V. Chen
*Attorney, Agent, or Firm*—Synnestvedt & Lechner LLP

[57] ABSTRACT

A retractable work table assembly for use with a housing such as an electrical panel is disclosed. The housing is mountable on a bracket to which a table member is slidably attached. The table member is formed from a flat plate which can have side panels around the perimeter to form a trough. The table member is attached to the upper end of the bracket via a biasing member, and is slidably movable between a retracted position in which the table member is positioned behind the housing, and an extended position in which the table member is positioned extending from the housing at a right angle. The table member can have a retaining member mounted on the flat plate for engaging the housing to retain the table member in the extended position.

15 Claims, 5 Drawing Sheets

RETRACTABLE WORK TABLE ASSEMBLY

FIELD OF THE INVENTION

This invention relates to work tables which are movably attached to a device, structure, or housing to provide a work surface which can be stowed away when not in use.

BACKGROUND OF INVENTION

Junction boxes and other devices used for telecommunications, cable television, power distribution, control systems and the like often require servicing by technicians to, for example, add new telephone or cable service lines, replace malfunctioning components, polish and splice optical fibers, replace circuit breakers or spent fuses. The technician must often use a number of tools or handle numerous small parts when servicing a box, and many technicians find it convenient to bring a portable work table which they set up near the box to provide a ready surface upon which to place their tools and components while they work.

While the use of a work table may be convenient, carrying the table from one site to another, setting it up and breaking it down is not. Additionally, the junction box or other device to be serviced may be mounted high above the ground on a structure such as the side of a building, a utility pole, or a microwave or a radio transmission tower, where there is no convenient place to set up an extra table for use by the technician.

Clearly there is a need to provide a convenient work table for use by technicians servicing equipment which would be useable under all conditions no matter where the device to be serviced was located. Ideally the work table should require only a minimum of time and effort to set up and break down, and it furthermore should not comprise an extra piece of equipment which a technician must transport to and from a work site.

SUMMARY AND OBJECTS OF INVENTION

The retractable work table assembly according to the invention provides a solution to the above identified problems. The work table assembly is intended to be used with equipment which may not have the room internally to house or store a work table. The work table assembly is therefore designed to fit behind the housing of a junction box or other device and slidably move between a retracted position, in which the table is enclosed behind the housing and out of the way, to an extended position in which the table presents a work surface which extends at substantially a right angle to the housing convenient for the placement of tools, components and the like. The table thus positioned is ideally suited to catch small parts that fall from the housing or are dropped by the technician. Fewer parts will be lost or damaged if the retractable work table assembly according to the invention is used.

The retractable work table assembly according to the invention comprises a bracket member mountable to a surface such as the wall of a building which provides a space between the surface and the housing. The work table assembly also comprises a table member, essentially a flat plate which provides a work surface. In the retracted position, the table member is retained in the space between the housing and the surface. A biasing member connected between the bracket member and the table member biases the table member into the retracted position. The table member is movable from the retracted position to an extended position in which the table member is extended substantially perpendicular to the housing. A retaining member attached to the table member can be provided to hold the table member in place in the extended position.

Preferably the biasing member is a spring which is attached to the upper end of the bracket member and one end of the table member, and the retaining member comprises a clip mounted on the surface of the plate. The clip has a hook adapted to interengage the housing, preferably along an edge near the bottom of the housing, and hold the table member in its extended position. Biasing forces from the spring pull on the table member to urge the hook into interengagement with the housing, thereby helping retain the table member in the extended position. It is advantageous to provide a flexible member between the spring and the edge of the table member which helps to direct the biasing forces of the spring from a substantially vertical direction, in which the spring pulls in order to bias the table member into the retracted position, to a substantially horizontal direction, in which the spring pulls to urge the hook into interengagement with the housing.

The table member and bracket member are preferably made from sheet metal, although other materials, such as PVC could also be used. Side panels or a lip which extend normal to the table member are positioned around the perimeter of the plate to form a trough which is useful to prevent tools and parts from rolling or sliding off of the table member.

It is an object of the invention to provide a convenient work surface for use by a technician when servicing a device.

It is another object of the invention to provide a work table which is movable between a retracted position where the table is out of the way, and an extended position in which the table provides a work surface to hold small tools and components.

It is still another object of the invention to provide a work table assembly which can be retrofitted to existing housings.

It is again another object of the invention to provide a work table assembly which is positioned outside of a housing.

It is yet another object of the invention to provide a work table which is positioned to catch small parts or tools if they are dropped by the technician.

These and other objects of the invention will become apparent upon consideration of the drawings and detailed description of the preferred embodiment.

DETAILED DESCRIPTION OF PREFERRED EMBODIMENTS

Figure 1:
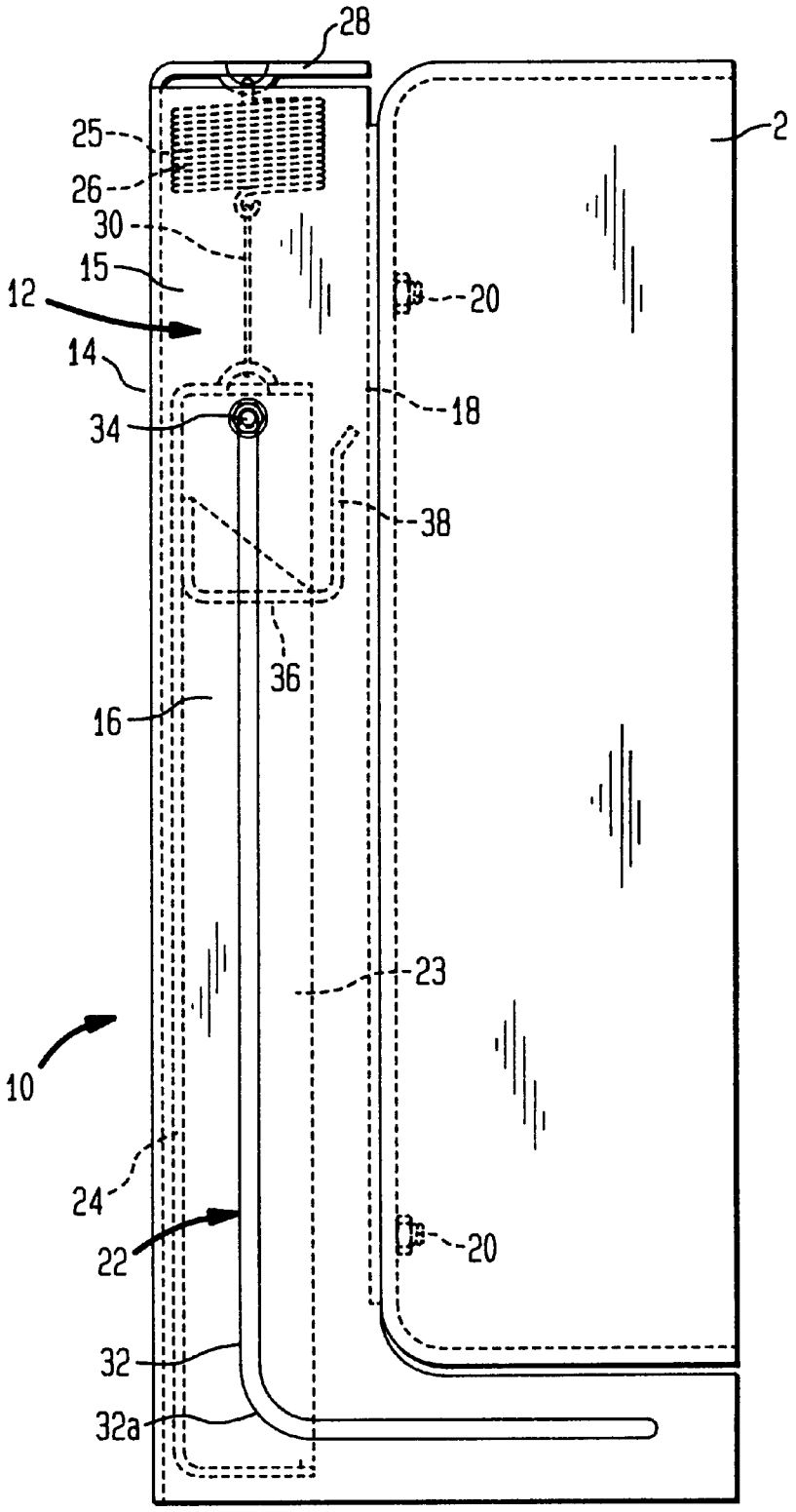
FIG. 1 shows a side view of the retractable work table assembly according to the invention and a side cross sectional view of a housing with which the work table is used, the table assembly being in the retracted position.

FIG. 1 shows a side view of a retractable work table assembly 10 according to the invention. Work table assembly 10 is used with a housing 2, shown in a side cross sectional view. Housing 2 represents any type of junction box or other structure with which a work table might be used, for example, a building entry protection unit (BEP). BEPs are commonly used to connect the telephone lines within a building to the external lines of a regional telephone system. BEPs typically contain wiring blocks, connectors, and electrical surge protection equipment, and can also house optical fiber junctions as well as other components. When servicing a BEP, a retractable work table according to the invention would provide a convenient surface upon which to place tools and small parts, or to perform wire or optical fiber splicing.

Work table assembly 10 comprises a bracket member 12 which has a back plate 14 and a pair of sidewalls 16 extending perpendicularly from back plate 14 in a parallel, spaced apart relation. Back plate 14, seen best in FIGS. 4 and 5, mounts onto a fixed surface such as a wall, and the housing 2 mounts onto bracket member 12 by means of a pair of flanges 18, also seen in FIGS. 4 and 5, which extend from sidewalls 16 and which are arranged parallel to and spaced apart from back plate 14. Attachment of housing 2 is by mounting bolts 20, or any other means as are well known in the art. It is seen that the bracket member 12 defines a space 15 between the housing 2 and the surface (wall) to which it mounts.

A table member 22 is shown in the retracted position in FIG. 1 in which the table member is retained within space 15 between the sidewalls 16 and behind the housing 2. Table member 22 comprises a flat plate 24 which furnishes the work surface for supporting tools, components and the like. In a preferred embodiment the table member has side panels or lip member 23 which extend perpendicularly from plate 24 around its perimeter. Side panels 23 form a trough which prevents tools and small parts from rolling or sliding off of the table member.

A biasing member 25, preferably in the form of a spring 26 (as shown), is attached to the upper end of bracket member 12. A back wall 28 arranged at the top of bracket member 12 provides a convenient attachment point for spring 26. The other end of spring 26 is attached to one end of table member 22. Attachment of the spring to the table member is preferably by means of a flexible member 30, for reasons explained below.

Figure 2:
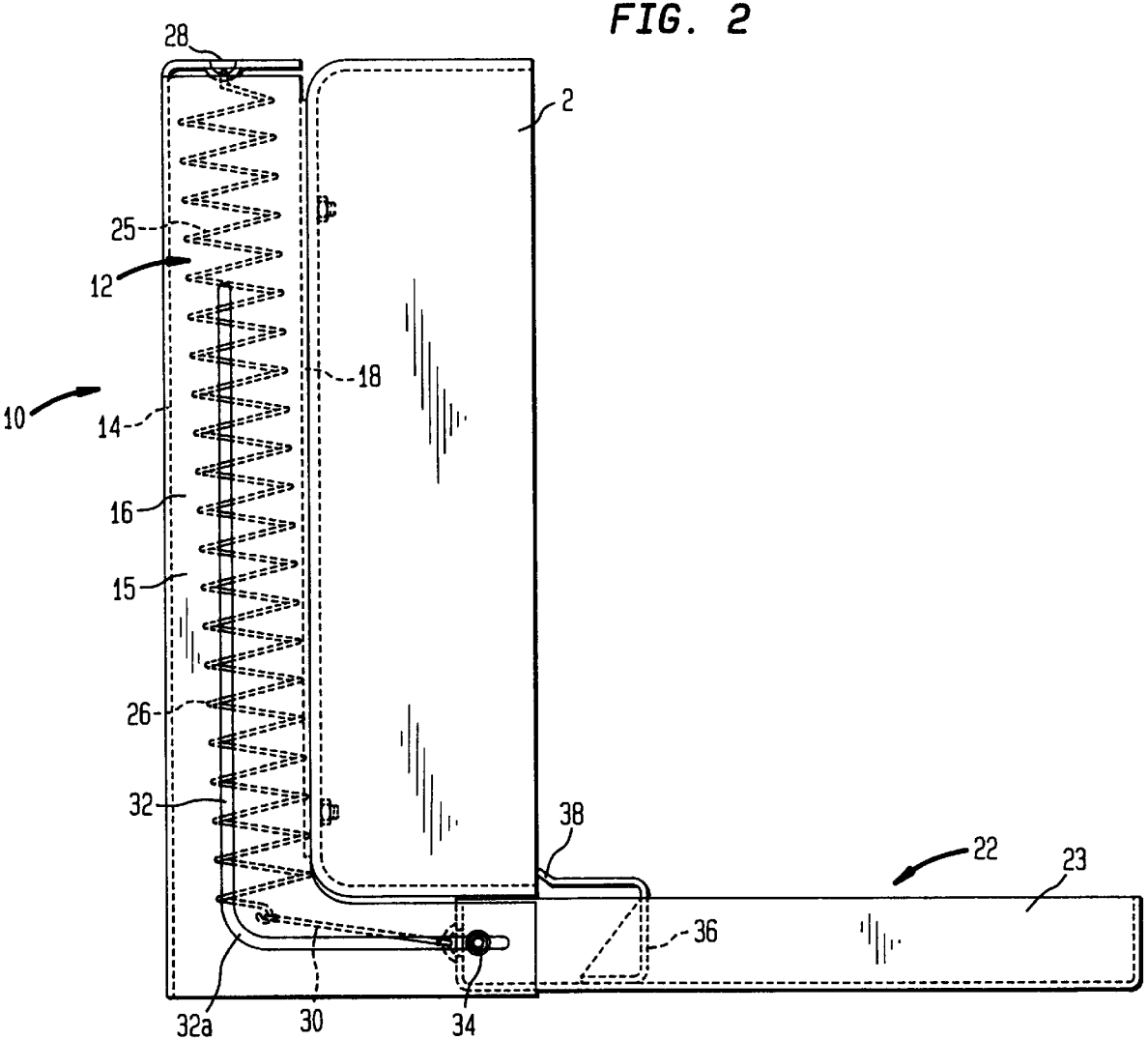
FIG. 2 shows the retractable work table assembly of FIG. 1 being moved into its extended position.
Figure 3:
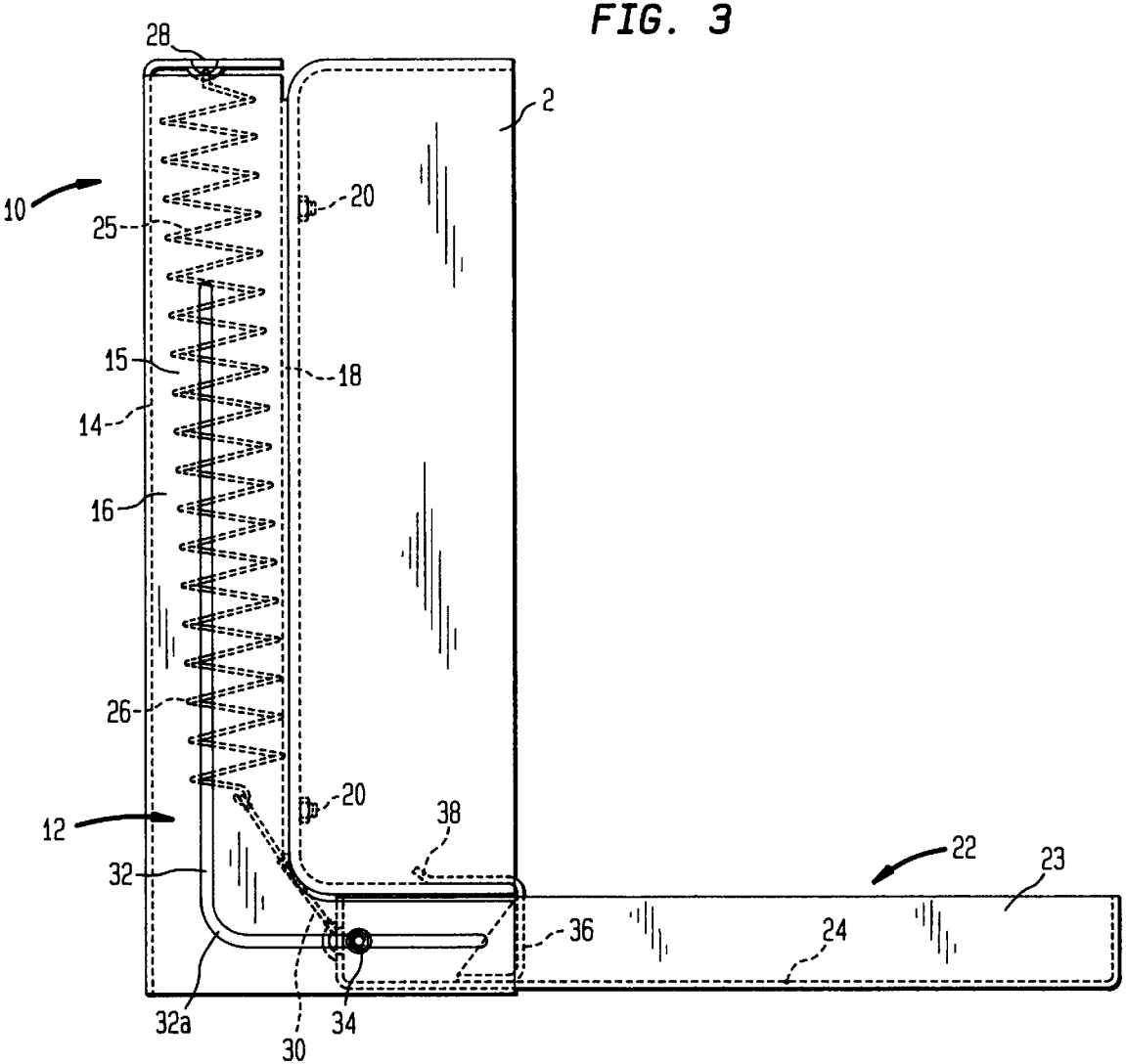
FIG. 3 shows the retractable work table assembly of FIGS. 1 and 2 in its extended position and interengaging the housing.

Spring 26 biases table member 22 into the retracted position shown in FIG. 1, but table member 22 is slidably movable into the extended position as shown in the series of drawings FIGS. 1, 2, and 3. The technician can move the table from the retracted to the extended position by pulling table member 22 downward against the biasing force of spring 26 (note there is no bottom on bracket member 12) and rotating the table member as it emerges from behind housing. The path of table member 22 between the retracted and extended positions can be defined by a pair of guide slots 32, one slot being in each sidewall 16. Guide slots 32 are formed lengthwise along the bracket sidewalls and table member 22 has a pair of studs 34 extending from opposite sides of the table member, each stud 34 engaging a respective guide slot for sliding motion of the table member along the path defined by the slots.

Figure 4:
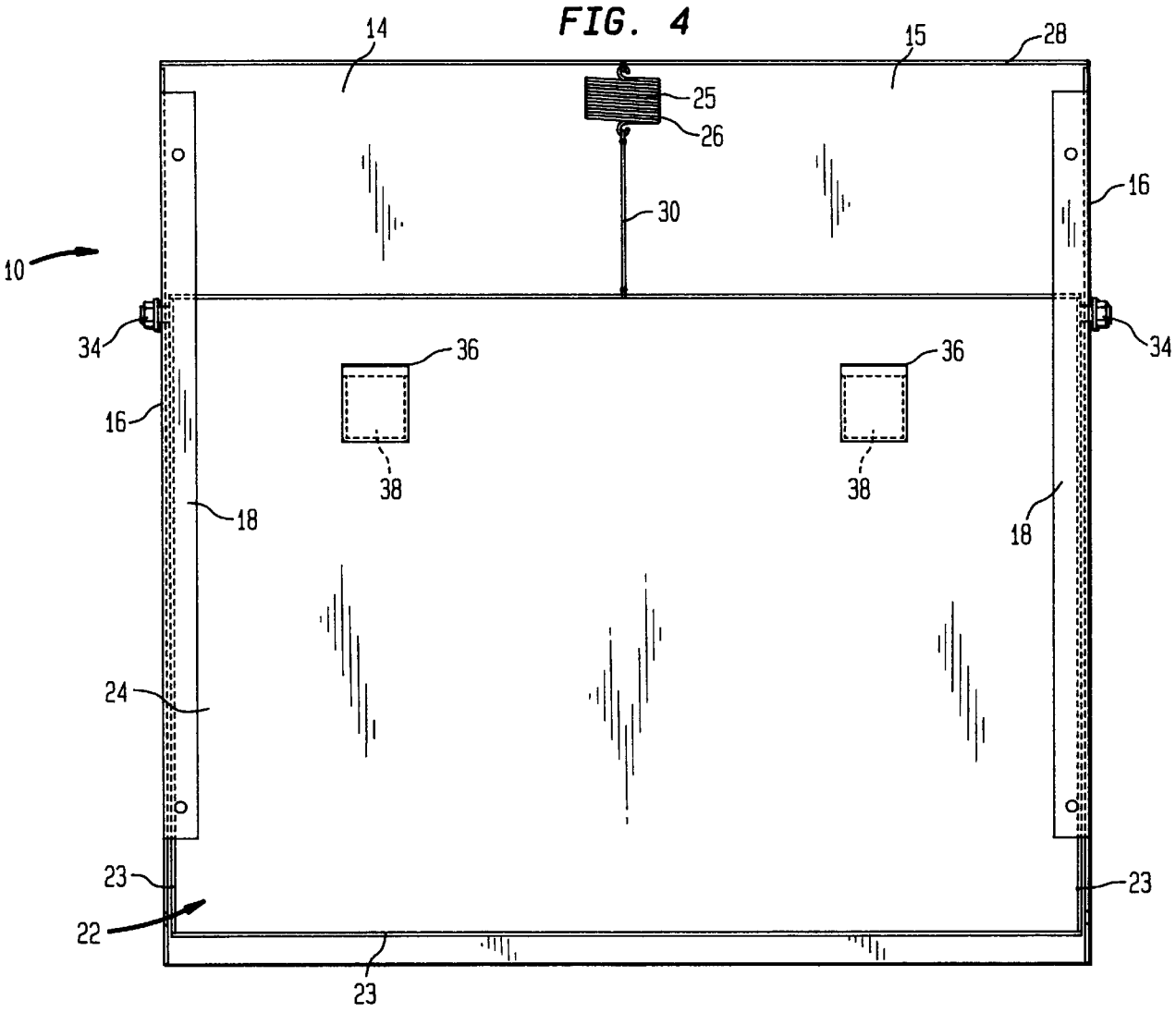
FIG. 4 shows a front view of the retractable work table assembly in the retracted position.
Figure 5:
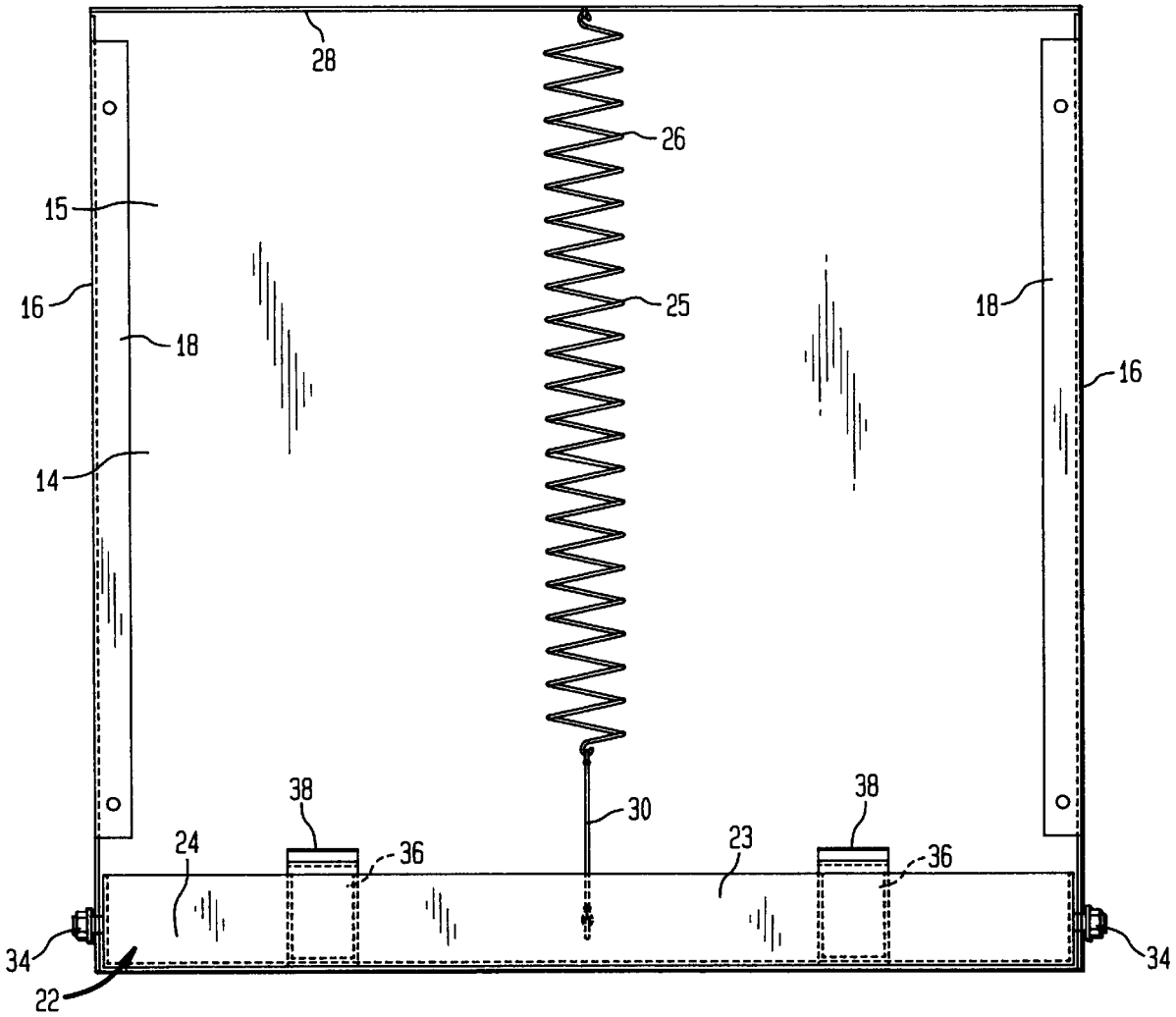
FIG. 5 shows a front view of the retractable work table assembly in the extended position.

As seen in FIG. 2, 3 and 4, table member 22 has one or more retaining members preferably comprising clips 36 mounted to plate 24 and extending outwardly therefrom. Clips 36 each have a hook 38 extending from the clip, the hook 38 being oriented parallel to and spaced apart from plate 24. When side panels 23 are present hooks 38 are spaced above the level of the side panels so that they can engage the housing 2 as shown in FIG. 3. Table member 22 is pulled outward from the bracket member 12 perpendicular to the housing and the bracket member as shown in FIG. 2. Note that when the guide slots 32 are used they have a curved portion 32*a* which permits the table member to move perpendicular to the housing as required. Table member 22 is pulled outwardly until retaining clip 36 is clear of housing 2, and the table member is adjusted upward so that a portion of the housing, preferably an edge at the bottom, is positioned between hooks 38 and a part of the table member 22, preferably side panels 23. The table member is then moved toward the housing until hooks 38 engage housing 2 as seen in FIG. 3. The hooks 38 and the side panels 23 impinge on the lower part of housing 2 to maintain the table member in the extended position. Note that although two retaining clips 36 are preferred, the invention would function with only one.

Spring 26 exerts a biasing force on table member 22, urging the table member into interengagement with the housing. Flexible member 30, which is preferably a short length of cable, is useful in conveying the biasing force of spring 26 from the substantially vertical direction in which the spring is generally oriented, to the horizontal direction, in which the spring must pull to help retain table member 22 in the extended position.

Table member 22 can be easily returned to the retracted position by sliding the table member outwardly away from housing 2, thereby disengaging hooks 38. Once the hooks are completely disengaged and clear of the housing as seen in FIG. 2, table member 22 is adjusted downwardly so that the hooks can pass beneath the housing. The table member is then moved along the path defined by the guide slots 32, and rotated into a vertical orientation to pass upwardly between sidewalls 16 and behind housing 2. Biasing spring 26 draws the table member upwardly into the retracted position shown in FIG. 1, the table member being retained in that position by the spring until it is again needed.

It is preferable to make the retractable work table assembly from sheet metal, although other materials, such as PVC, can also be used.

The retractable work table assembly according to the invention provides a convenient work surface for use by a technician, and the work table is versatile and easily adaptable to a wide variety of uses with various types of housings and structures.

What is claimed is:

1. A retractable work table assembly for use with a housing and which is mountable to a surface, said table assembly comprising:

a bracket upon which the housing can be mounted, said bracket defining a space between said housing and said surface when mounted thereto;

a table member comprising a substantially flat plate and movably supported on said bracket, said table member being slidable between a retracted position wherein said table member is disposed within said space, and an extended position wherein said table member is extended substantially perpendicular to said housing, said table member including at least one retaining member mounted thereon capable of engaging the housing to hold said table member in said extended position, said retaining member having a hook whose end extends substantially parallel to and is positioned above said plate, said hook being configured to engage an edge of said housing when said table member is in said extended position to thereby hold said table member in said extended position; and a biasing member supported on said bracket and flexibly connected to said table member to allow said table member to move into said extended position substantially perpendicular to said housing, said biasing member for biasing said table member into said retracted position.

2. A retractable work table assembly according to claim 1, wherein said table member includes a lip located around a portion of the perimeter of said plate and oriented substantially perpendicular thereto.

3. A retractable work table assembly according to claim 1, wherein said bracket includes a pair of sidewalls, each of said sidewalls having a guide slot, said table member further comprising a pair of studs extending from said table member and interengaging said guide slots, said guide slots configured to guide said table member in sliding motion between said retracted position and said extended position.

4. A retractable work table assembly according to claim 1, wherein said biasing member comprises a spring having one end connected to said bracket and an other end connected to said table member.

5. A retractable work table assembly according to claim 4, further comprising an elongated flexible member interposed between said other end of said spring and said table member for flexibly attaching said spring to said table member.

6. A retractable work table assembly in accordance with claim 4, wherein said spring is positioned to further bias said retaining member into interengagement with the housing when said table member is in said extended position.

7. A retractable work table assembly according to claim 1, wherein said bracket comprises a substantially flat plate having two sidewalls extending substantially normal to said plate in a parallel, spaced-apart relationship, said sidewalls having flanges oriented parallel to and spaced apart from said plate for mounting the housing to said bracket.

8. A retractable work table assembly according to claim 1, wherein said table member is formed from sheet metal.

9. A retractable work table assembly for use with a housing, said table assembly comprising:

a table member comprising a substantially flat plate having a face oriented toward said housing;

a bracket member having a pair of sidewalls arranged in a parallel, spaced apart relation to accept said table member therebetween, said table member being movably supported between said sidewalls;

a retaining member mounted on said table member for holding said table member in an extended position, said retaining member comprising a clip mounted on said table member face, said clip having a distal end extending from said face toward said housing and a hook mounted on said distal end, said hook having a surface disposed in a parallel, spaced apart relation to said face, said housing being disposed between said surface and said table member face when said table member is in said extended position, said surface and said table member engaging said housing, said table member being movable between a retracted position wherein said table member is positioned between said sidewalls, and the extended position wherein said table member extends substantially perpendicular from said housing; and a biasing member flexibly connected between said bracket member and said table member, said biasing member positioned for urging said table member into interengagement with the housing when said table member is in said extended position.

10. A retractable work table assembly according to claim 9, wherein said biasing member comprises a spring having an end connected to said bracket member.

11. A retractable work table assembly according to claim 10, further comprising a flexible member interposed between said spring and said table member.

12. A retractable work table assembly according to claim 9, wherein said sidewalls each have an elongated guide slot arranged lengthwise thereof, and said table member has a pair of studs extending outwardly from opposite sides of said table member adjacent to said sidewalls, each of said studs engaging a respective said guide slot for sliding motion along said guide slot, said studs and said elongated guide slots guiding said table member in sliding motion between said retracted position and said extended position.

13. A retractable work table assembly according to claim 9, wherein said table member further comprises a plurality of side panels extending substantially perpendicular from said plate and positioned around the perimeter of said plate to form a trough.

14. A retractable work table assembly according to claim 9, wherein said bracket member is formed from sheet metal.

15. A retractable work table assembly according to claim 9, wherein said retaining member is positioned to interengage a bottom edge of said housing when said table member is in said extended position.

* * * * *